United States Patent [19]

Unruh

[11] 4,001,361

[45] Jan. 4, 1977

[54] MOBILE HOME SKIRTING SIDE PANEL

[76] Inventor: Earl L. Unruh, 612 Pinewood Drive, San Jose, Calif. 95129

[22] Filed: Oct. 29, 1974

[21] Appl. No.: 518,345

[52] U.S. Cl. ..... 264/51; 52/309.1; 52/314; 52/593; 52/DIG. 3; 264/45.5; 264/293; 264/129

[51] Int. Cl.[2] ..... E04C 2/20; B29D 27/00

[58] Field of Search ..... 52/314, 316, 309, 311, 52/DIG. 3; 280/150 R; 161/159, 130, 139, 160, 131; 264/45.4, 48, 51, 293

[56] References Cited

UNITED STATES PATENTS

| | | | |
|---|---|---|---|
| 2,931,130 | 4/1960 | Rietz | 52/314 |
| 3,054,146 | 9/1962 | Griffin | 264/51 |
| 3,106,411 | 10/1963 | Holmes | 280/150 R |
| 3,328,228 | 6/1967 | Ford | 52/316 X |
| 3,496,694 | 2/1970 | Hicks | 52/314 |
| 3,515,779 | 6/1970 | Jones | 264/51 |
| 3,552,076 | 1/1971 | Gregori | 52/309 |
| 3,613,326 | 10/1971 | Mollman | 52/314 |
| 3,700,516 | 10/1972 | Sullivan | 52/309 |
| 3,882,218 | 5/1975 | Bixel | 264/157 |

*Primary Examiner*—John E. Murtagh
*Attorney, Agent, or Firm*—C. Michael Zimmerman

[57] ABSTRACT

A skirting side panel for mobile homes and the like is formed of a sheet of fused polystyrene beads and a coating of water based paint on one surface thereof. The sheet is molded with a plurality of raised portions on one surface providing a masonry appearance, such as mortared slump stone. Opposite side edges of the sheet have spaced projecting portions which interlink with corresponding edges of adjacent sheets to form a continuous skirt. Moreover, the polystyrene beads define cavity interstices on the masonry surface simulating the surface cavitations normally found on masonry blocks.

1 Claim, 4 Drawing Figures

MOBILE HOME SKIRTING SIDE PANEL

BACKGROUND OF THE INVENTION

This invention relates generally to skirting panels for mobile homes and the like, and more particularly to a light weight and high strength skirting panel having the appearance of a masonry wall or similar building structure when attached to similar panels.

When house trailers or mobile homes are to remain stationary for extended periods of time, it is the practice to raise such units on blocks, such that the unit is rigidly mounted on a ground surface. The undercarriage of the mobile home is, of course, then visible and presents an unattractive or unpleasing appearance. Accordingly, the majority of mobile home owners attach a skirting which extends from an edge of the trailer to ground level. Generally, a decorative skirting is employed which enhances the appearance of the mobile home.

In the past, various types of skirting panels have been employed to enclose the underside of a mobile home and for other purposes. For example, sheets of aluminum stamped or molded to provide the appearance of a conventional construction material facade are now commonly employed as siding panels. Aluminum sheets, however, are not particularly desirable for a number of reasons. For one thing, it is difficult economically to achieve a surface treatment on aluminum which will realistically simulate the construction materials, e.g., masonry block, more commonly used for this purpose. Moreover, aluminum sheets employed as siding panels generally have a surface coating of paint thereon and adverse weather conditions and changing temperatures often cause the paint to peel, thereby producing an unpleasing appearance. Furthermore, aluminum sheets are easily dented and cannot withstand relatively high winds. Also, buckling and flexing of aluminum sheets under certain conditions, such as when subject to a high wind, can generate a considerable amount of noise.

Because of such problems, many trailer owners build actual wooden or masonry walls to surround the lower portion of the house trailer. It can be readily appreciated, however, that such structures are exceedingly expensive to build and maintain. This is particularly true of masonry walls. Masonry walls also have the distinct disadvantage of restricting entry to the underside of the house trailer, such as is required to make repairs. Furthermore, structures such as wooden and masonry walls are not easily removable when it is necessary to move the trailer to another site.

SUMMARY OF THE INVENTION

The present invention provides a skirting panel which while being quite light weight has a high strength and is capable of realistically simulating a construction facade. In general terms, the panel comprises a sheet of rigid cellular plastic material having opposite side edges which are conformably shaped to one another to permit each to matingly interlink with the edge of an adjacent sheet. The front face of the sheet is provided with a surface configuration simulating a desired construction facade. Most desirably, the construction facade is one having a multiplicity of units of a building material, e.g., shingles, brick or the like, and the spaced projecting portions conform to such units so that interlinked adjacent sheets will appear as one continuous wall. A preferred panel is one in which the surface configuration includes a plurality of generally rectangular raised portions which provide the appearance of masonry blocks, such as bricks or slump stones. The projecting portions on the side edges of adjacent panels then interlink similarly to the manner in which masonry blocks conventionally interlink. Most desirably, the rigid cellular plastic material forming the panel is provided by a multitude of thermoplastic polymer beads, such as polystyrene beads, fused together. Under proper conditions, such fusing of the beads at the surface will provide the surface with cavity interstices between adjacent beads which will realistically simulate those surface cavities found on many construction materials, particularly on masonry blocks. This surface treatment, together with the interlinking of projecting portions of adjacent panels, simulates units of building construction, and provides the panel of the invention with a natural appearing surface not available with panels of aluminum or other metal. The panel of the invention provides this realistic appearance simulation in addition to being quite light weight and suitable for its purposes.

The invention includes other features and advantages which will be described or will become apparent from the following more detailed description of a preferred embodiment.

BRIEF DESCRIPTION OF THE DRAWING

With reference to the accompanying single sheet of drawing.

DETAILED DESCRIPTION OF A PREFERRED EMBODIMENT

Figure 1:
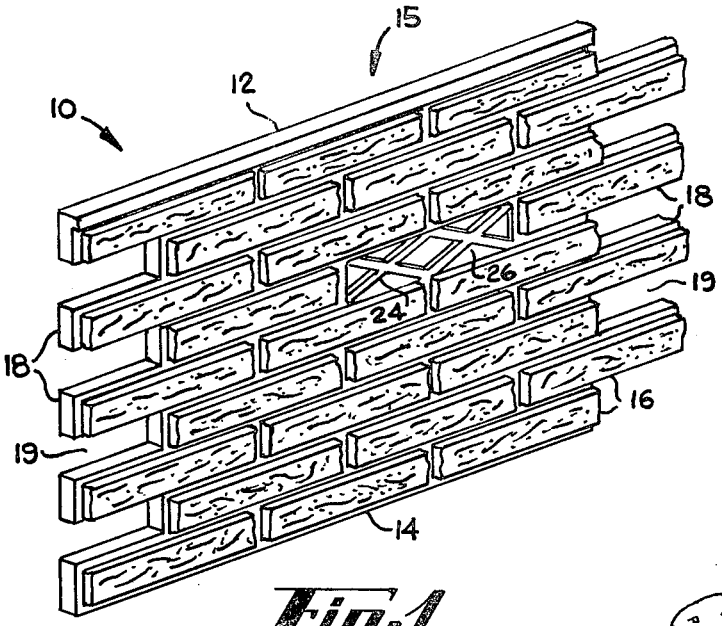
FIG. 1 is a view in perspective of a preferred embodiment of a skirting side panel incorporating the invention.

With reference to FIG. 1, a skirting side panel for house trailers and the like incorporating the present invention is generally designated with the reference numeral 10. The panel 10 is formed of a sheet of a rigid cellular plastic material, such as polystyrene. The sheets preferably have a density of from 1 to 2 pounds per cubic foot in order to have adequate strength and yet be light weight. The panel 10 is provided with a top edge 12 which is disposed for being attached to the bottom edge of a house trailer or the like, as will be explained in greater detail below. The bottom edge 14 of the panel 10 is also securable to a ground surface as will also be explained below.

The front face 15 of the panel has a surface configuration simulating a construction facade. More particularly, such surface is provided with a plurality of generally rectangular raised portions representing masonry blocks. The result is that the surface of the panel has the overall appearance of a masonry wall. In the particular embodiment illustrated, each of the rectangular portions simulates a slump stone so that the panel looks like a slump stone wall.

As one salient feature of the instant invention, means are provided for interlinking adjacent panels with one another in a manner which assures structural integrity of the linked panels while obscuring the fact that it is panels being linked, rather than individual slump stones. That is, each of the opposite side edges of the panel 12 is provided with a plurality of projecting edge portions 18 which are receivable in corresponding spaces 19 between the projecting edge portions of an adjacent panel. The projecting portions represent slump stones to provide a continuation from one panel to another of the staggered stone arrangement between alternate rows of such stones. In other words, the periphery of each of the projecting portions 18 is generally coterminus with at least a portion of the periphery of one of the rectangular raised portions simulating a slump stone, with the result that the projecting portion has the appearance of a portion of a slump stone. Thus, when adjacent panels are interfitted with one another, the joint between such panels will follow the natural joint normally found between slump stones in a slump stone wall. This will reduce the visibility of the joint while also providing a good structural connection between the panels in view of the interlinking.

As another salient feature of the invention, the panel is constructed from a multitude of thermoplastic polymer beads fused together. This will provide the front face of the sheet with a surface configuration having cavity interstices simulating the surface cavitations or pockets commonly found on many actual construction materials, such as masonry blocks. More particularly, rather than the panel being molded from a polymer in liquid form, the panel is constructed by molding beads of the desired polymer material. In this connection, it has been found that expandable polystyrene beads, such as those sold under the trademark "STYROPOR" by BASF Corporation, are particularly applicable to the instant invention. The panels are made from such beads by providing a mold having a mold surface complementary to the surface configuration of the construction facade which is to be simulated. The mold is filled with partially expanded beads of the thermoplastic material, and heat is then applied to the mold to fuse the beads together and form the desired panel with the surface cavitation. The beads are preferably of the self-extinguishing type, i.e., the type which will inhibit the panel sustaining flame.

It will be appreciated that the amount of surface cavitation will depend upon the degree to which the beads are fused together at the surface. In this connection, the art of molding objects from polymer beads is well developed, and those skilled in the art can select the parameters applicable to their particular conditions in order to produce surface cavitation. It should be remembered, however, that although for appearances sake it is desirable to have some cavitation at the surface, it is important to provide a good fusion of adjacent beads in order for the panel to have structural integrity.

It is known that the density of a block of material formed from expandable polystyrene beads is selectable by controlling the degree to which the beads are expanded. It has been found that bead expansion providing the panel with a density of between about 1 and 2 pounds per cubic foot will result in the panel having satisfactory structural strength while yet being light weight. As an example, suitable surface cavitation has been obtained without affecting the structural integrity of the final panel by first partially expanding polystyrene beads prior to their injection into a hollow cavity mold, and then subjecting the beads to a temperature in the range of between about 115° and 130° F. for about 30 to 90 seconds after they are injected into the mold. The heating within the cavity mold is effected by introducing steam into the mold under a pressure of between about 12 and 20 p.s.i. After being heated, the mold is immediately cooled with water or the like so as to terminate further bead expansion.

Figure 3:
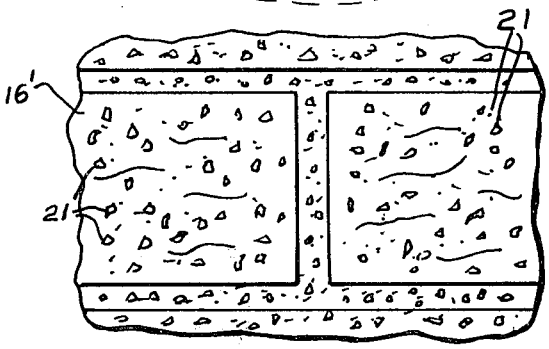
FIG. 3 is an enlarged plan view of a portion of a panel of the invention illustrating details of the surface configuration thereof.

FIG. 3 is a magnified view of the surface configuration illustrating the surface cavitations which can be formed by making the panel from fused together, expandable polystyrene beads. The surface cavities in a raised portion 16', for example, are referred to by the reference numeral 21.

The masonry effect of the front face of the panel can be enhanced by the proper application of paint in suitable colors on the raised portion 16 and in the recesses between the raised portions. Each of the panels is thus provided with a coating of paint, generally designated with the reference numeral 22 on at least the outer surface of the panel 10. Most desirably, such paint is a water based one providing fire retardation.

Figure 2:
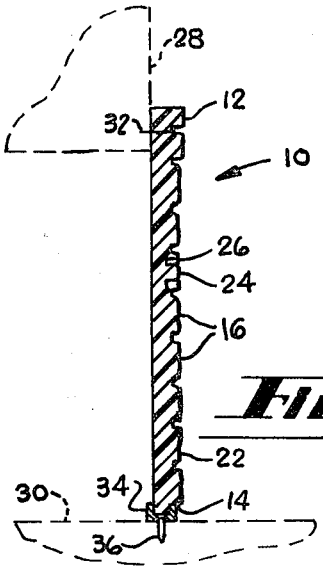
FIG. 2 is a sectional view of the panel illustrated in FIG. 1 showing means for attaching such a panel between a mobile home and a ground surface.

As shown in FIG. 2, the panel 10 is adapted for securing to a bottom edge of a trailer, which is shown in phantom lines and designated with the reference numeral 28, and to a ground surface which is also shown in phantom lines and designated with the reference numeral 30. A plurality of fasteners 32, such as screws, extend through the top edge 12 of the panel 10 and engage a bottom edge of the trailer 28. A channel 34 is mounted on the ground surface 30 by means of fasteners 36, and the bottom edge 14 of the panel 10 is received therein.

Figure 4:
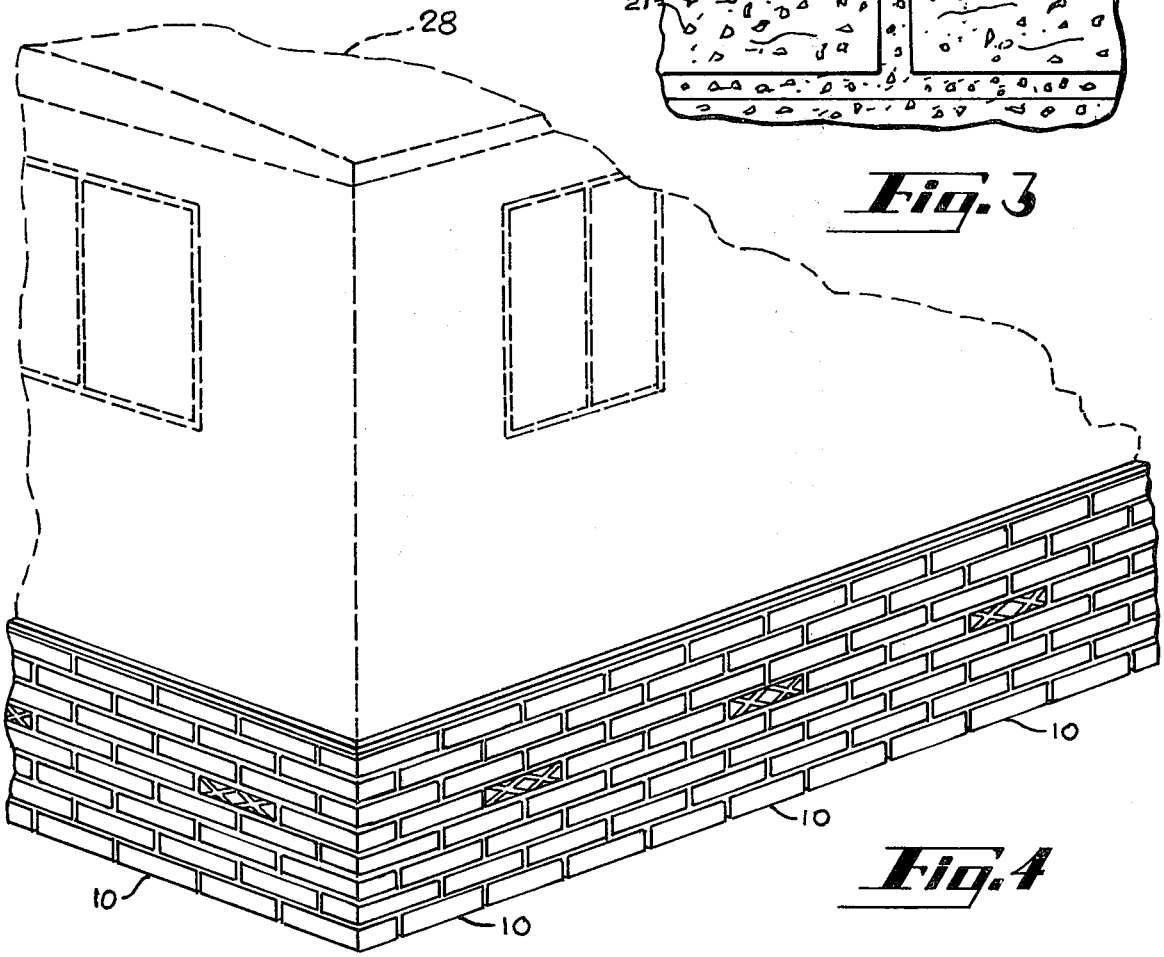
FIG. 4 is a view in perspective of a plurality of skirting side panels corresponding to the panel of FIG. 1 attached together to enclose the underside of a mobile home.

FIG. 4 illustrates the manner in which the edges of adjacent panels 10 interlink with one another to form a continuous skirting structure surrounding the underside portion of the trailer 28. The edges of the panels 10 which abut against one another at the corners of the trailer 28 can be mitered to mate with one another as shown. Alternatively, corner edging consisting of planks or angle members of any suitable material, for example, can cover the edge joint. Also one section of each panel 10 on its outer surface is provided with a cross-shaped raised portion 24 having relatively thin portions 26 therebetween which form knockouts, if it is desirable to have ventilating openings to the underside portion of the house trailer.

In a constructed embodiment of the present invention, the panels were provided with an overall length of 56 inches and a width of 36 inches. The panel had a thickness of approximately ¾ inch with the thickness of the raised portions being from 1¼ to 1½ inches. Of course, different dimensions can be chosen depending on the purpose for which the panel is designed.

Although the invention has been described in connection with a preferred embodiment thereof, it will be appreciated by those skilled in the art that various modifications can be made without departing from the spirit of the invention. For example, although the surface portion of the panel is shown formed from masonry blocks, other construction materials, such as wood shingles, can also be simulated. It is preferable, though, that the construction material be one that is provided in units, e.g., shingles, separate boards, bricks, etc., so that the feature of making the interlocking portions on the edges of the panel correspond to such units for low visibility is realized. In view of these and other changes, it is intended that the afforded coverage be limited only by the spirit of the invention as defined by the claims and their equivalent language.

I claim:

1. A process for forming a skirting panel having a surface configuration simulating masonry blocks comprising the steps of: providing a mold for said panel having a mold surface including a plurality of generally rectangular cavities complementary to masonry blocks; filling said mold with expandable beads of polystyrene; and applying heat to said beads to fuse the same together and form said panel with a density of between about 1 and 2 pounds per cubic foot, whereby cavity interstices are formed between fused beads at said surface configuration which simulate the surface cavitations on masonry blocks.

* * * * *